US009134092B2

(12) United States Patent
Spiegelhauer

(10) Patent No.: US 9,134,092 B2
(45) Date of Patent: Sep. 15, 2015

(54) FIREARM MODIFICATION ACCESSORY

(71) Applicant: Robert Spiegelhauer, Houma, LA (US)

(72) Inventor: Robert Spiegelhauer, Houma, LA (US)

( * ) Notice: Subject to any disclaimer, the term of this patent is extended or adjusted under 35 U.S.C. 154(b) by 182 days.

(21) Appl. No.: 13/890,235

(22) Filed: May 8, 2013

(65) Prior Publication Data

US 2014/0331538 A1 Nov. 13, 2014

(51) Int. Cl.
*F41C 23/16* (2006.01)

(52) U.S. Cl.
CPC ..... *F41C 23/16* (2013.01)

(58) Field of Classification Search
USPC ..... 42/71.01, 72, 74
See application file for complete search history.

(56) References Cited

U.S. PATENT DOCUMENTS

| | | | | |
|---|---|---|---|---|
| 4,328,633 | A * | 5/1982 | Pachmayr et al. | 42/74 |
| 4,536,982 | A | 8/1985 | Bredbury | |
| 5,010,676 | A | 4/1991 | Kennedy | |
| 5,621,997 | A * | 4/1997 | Pearce | 42/71.02 |
| 6,655,069 | B2 | 12/2003 | Kim | |
| 6,725,594 | B2 | 4/2004 | Hines | |
| 6,836,990 | B2 | 1/2005 | Shiloni | |
| 6,839,998 | B1 | 1/2005 | Armstrong | |
| 6,895,708 | B2 * | 5/2005 | Kim et al. | 42/72 |
| 7,121,034 | B2 | 10/2006 | Keng | |
| 7,216,451 | B1 | 5/2007 | Troy | |
| D591,822 | S | 5/2009 | Moody | |
| D613,811 | S | 4/2010 | Swan | |
| 7,731,380 | B2 | 6/2010 | Wu | |
| 7,805,873 | B2 * | 10/2010 | Bentley | 42/74 |
| 7,954,270 | B2 | 6/2011 | Bentley | |
| 8,104,218 | B2 | 1/2012 | McCann | |
| 8,109,032 | B2 | 2/2012 | Faifer | |
| 8,528,246 | B2 * | 9/2013 | Telles | 42/94 |
| 2005/0188593 | A1 | 9/2005 | Milan et al. | |
| 2009/0038200 | A1 | 2/2009 | Keng | |
| 2009/0313873 | A1 | 12/2009 | Roth | |
| 2010/0275489 | A1 | 11/2010 | Cabahug | |
| 2011/0265366 | A1 | 11/2011 | Hinds, Jr. | |

* cited by examiner

*Primary Examiner* — J. Woodrow Eldred
(74) *Attorney, Agent, or Firm* — Keaty Law Firm, LLC

(57) ABSTRACT

A bottom hand grip for a firearm, such as AK-47 type rifle is mountable on the rifle in place of a bottom forend. The bottom hand grip engages a front end of the receiver assembly and is further supported by an attachment bolt passing through its bottom plate. Double-walled body of the bottom hand grip is provided with a plurality of openings that help dissipate heat from the firing mechanism and also serve as a means for mounting a rail for a firearm accessory.

11 Claims, 6 Drawing Sheets

FIREARM MODIFICATION ACCESSORY

BACKGROUND OF THE INVENTION

The present invention generally relates to firearms, and more particularly to a modification accessory kit designed to replace a part of convention barrel cover for a AK-47 type model semi-automatic and automatic rifles, or variants thereof.

The Kalashnikov gas rifle, better known as the AK-47, and its variants comprise one of the largest groups of firearms in the world. It has been estimated that over 90 million of these firearms have been produced in dozens of countries since their introduction in the Soviet Union in 1946. Developed primarily as a military weapon, the AK-47 gas rifle became famous for its simplicity of operation and reliability in extreme conditions of use. Because of its mild recoil, the AK-47 type rifle has the capability of delivering effective fire at a range of 400 meters.

The AK-47 type firearms have a few problems that make it less than optimal for use as an assault weapon. One of these is directly related to the method of operation of the rifle. This firearm basically uses a portion of the high energy combustion gases from discharging the firearm to cycle the action for extracting a spent cartridge case and chambering a new round. A portion of the expanding combustion gases produced by discharging the rifles are ported from the barrel into a cylindrical piston bore containing an axially-movable reciprocating gas piston. The heat generated by the gas rifle is considerable and it does not readily dissipate since the bottom barrel cover is conventionally made of solid wood piece, which tends to trap the heat.

Another problem associated with the AK-47 type rifle is a lack of means to hold various accessories, such as optical scope, flashlight, etc. There exist a number of mounts for rifle accessories. One such type is known as Picatinny rail, which is a bracket used on some firearms in order to provide a standardized mounting platform for accessories and attachments, The Picatinny rails were originally used for mounting scopes on larger caliber rifles. Then their use expanded to other accessories, such as tactical lights, night vision scopes, and the like. However, AK-47 type rifles do not readily accept such types of accessories mounts.

The present invention contemplates elimination of drawbacks associated with heating of conventional AK-47 type rifles and provision of an accessory mount similar to Picatinny-style rail system.

SUMMARY OF THE INVENTION

It is, therefore, an object of the present invention to provide a kit for modifying AK-47 type firearm to facilitate heat dissipation from the receiver assembly.

It is another object of the invention to provide a kit for modifying AK-47 type firearm to allow mounting of various accessories on the rifle.

It is a further object of the invention to provide a modification forend device designed for mounting on a firearm.

These and other objects of the invention are achieved through a provision of a bottom hand grip device for a firearm, such as AK-47 type rifle. The bottom hand grip is detachably mounted in the firearm to replace the forend of conventional rifles. The device comprises an elongated bottom plate, a pair of outside walls extending upwardly from the bottom plate, a pair of inner walls extending upwardly from the bottom plate inwardly in relation to the outside walls and in a spaced relationship thereto. The inner walls define a channel therebetween capable of receiving at least a portion of the barrel assembly therein.

The bottom plate, the outside walls and the inner walls are each being provided with a plurality of openings allowing heat generated by the firearm to escape. These openings also serve as a means for attaching one or more mounting rails, such as for instance Picatinny-type rails and securing a variety of firearm accessories on the rifle.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
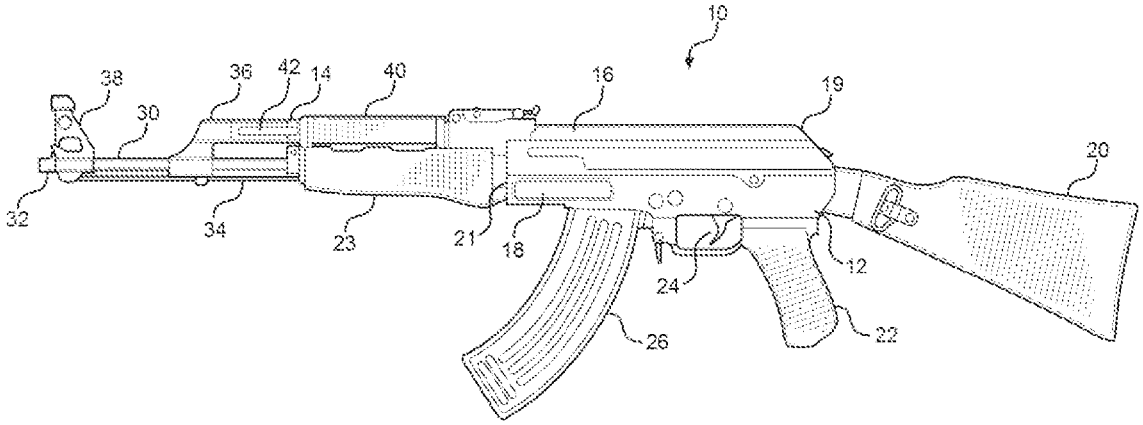
FIG. 1 PRIOR ART
FIG. 1 illustrates a conventional AK-47 type rifle.

Referring now to the drawings in more detail, numeral 10 designates a conventional AK-47 type rifle. The rifle 10 generally includes a receiver assembly 12 and a barrel assembly 14 affixed to the receiver assembly 12 and extending forwardly therefrom. In a gas piston type system, such as used in AK-47 type rifles, the combustion gases are transported into a gas cylinder mounted on the barrel which contains a reciprocating piston. The receiver assembly 12 includes an upper receiver 16 and a lower receiver 18. The lower receiver supports a butt stock 20, a handgrip 22, a trigger mechanism 24, and a magazine 26 designed to retain a plurality of cartridges. The lower receiver 18 has a proximal end 19 and a distal end 21. A slot (not shown) is formed in the distal end 21, and a bottom front grip or forend 23 is engaged with the slot.

The barrel assembly 14 comprises a barrel 30 having a muzzle end 32 and breech end 34. In conventional AK-47 type rifles the bottom front grip 23 is mounted below the breech end 34, extending a distance towards the muzzle end 32. The bottom hand guard 23 is conventionally formed from wood, which tends to trap the heat generated by the rifle firing system.

The barrel assembly 14 includes a barrel cover 36 and a front sight 38. A top front grip or upper handguard 40 is mounted on the orientating pole 42. The barrel cover 36 engages the orientating pole 42 forwardly in relation to the upper handguard 40 and also engages the barrel 30.

The rifle of the present invention has many similar features, as can be seen in FIGS. 2-6. The rifle 50 has a receiver assembly 52 and a barrel assembly 54 coupled to the receiver assembly 52. The receiver assembly comprises an upper receiver 56 and a lower receiver 58. The lower receiver supports a buttstock 60, a handgrip 62, a trigger mechanism 64 and a magazine 66. The magazine 66 is designed to hold a plurality of cartridges (not shown). The lower receiver 52 has a proximate end and a distal end 70. A slot 72 is formed in a lower part of the distal end 70.

The barrel assembly 54 includes an elongated hollow barrel 74 having a muzzle end 32 and a breech end 78. An orientating pole 80 extends substantially parallel to the barrel 74. A barrel cover 82 connects the barrel 74 with orientating pole 80. A front sight 84 is mounted on the muzzle end 76 of the barrel 74. A top front grip or upper hand guard 86 is mounted on the orientating pole 80 rearwardly in relation to the barrel cover 80.

The modification device or bottom hand grip (forend assembly) 90 according to the present invention is detachably engageable with the barrel assembly 54 and the receiver assembly 56. The modification device 90 is designed to replace the forend 23 of the conventional rifle 10.

Figure 2:
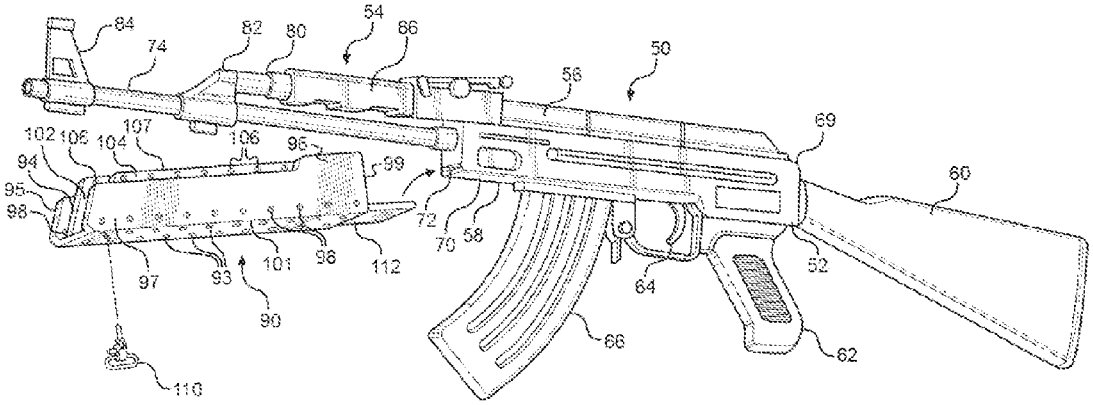
FIG. 2 is a perspective view of a firearm with a modification forend assembly shown in an exploded view.
Figure 3:
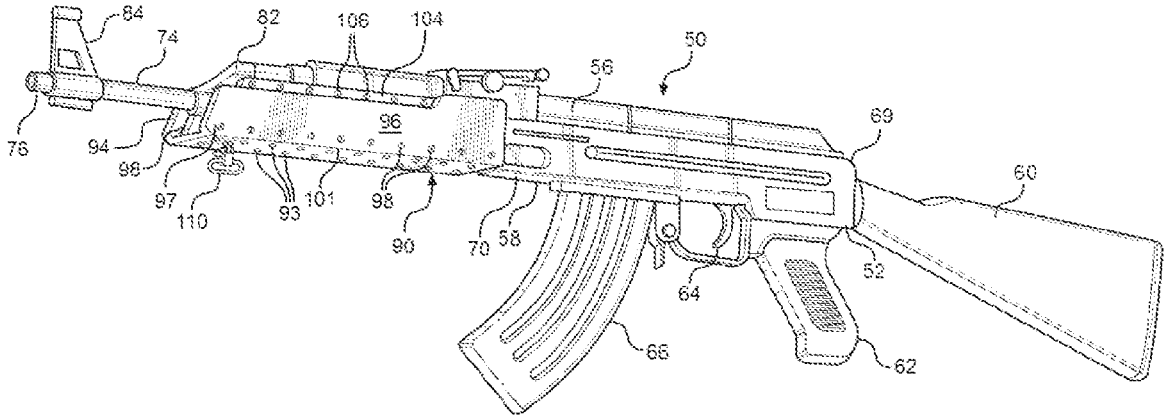
FIG. 3 is a perspective view of a firearm with the modification forend assembly engaged with a receiver assembly.
Figure 4:
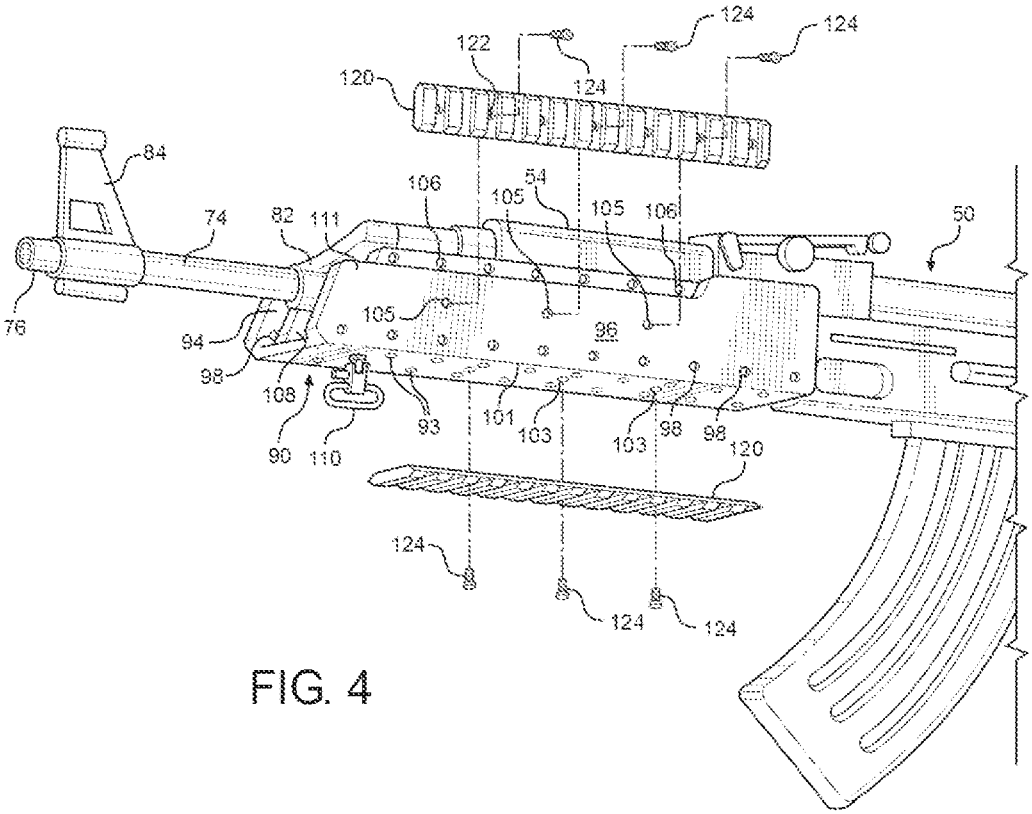
FIG. 4 is a detail view of the modified firearm showing mounting rails secured to the forend assembly.
Figure 5:
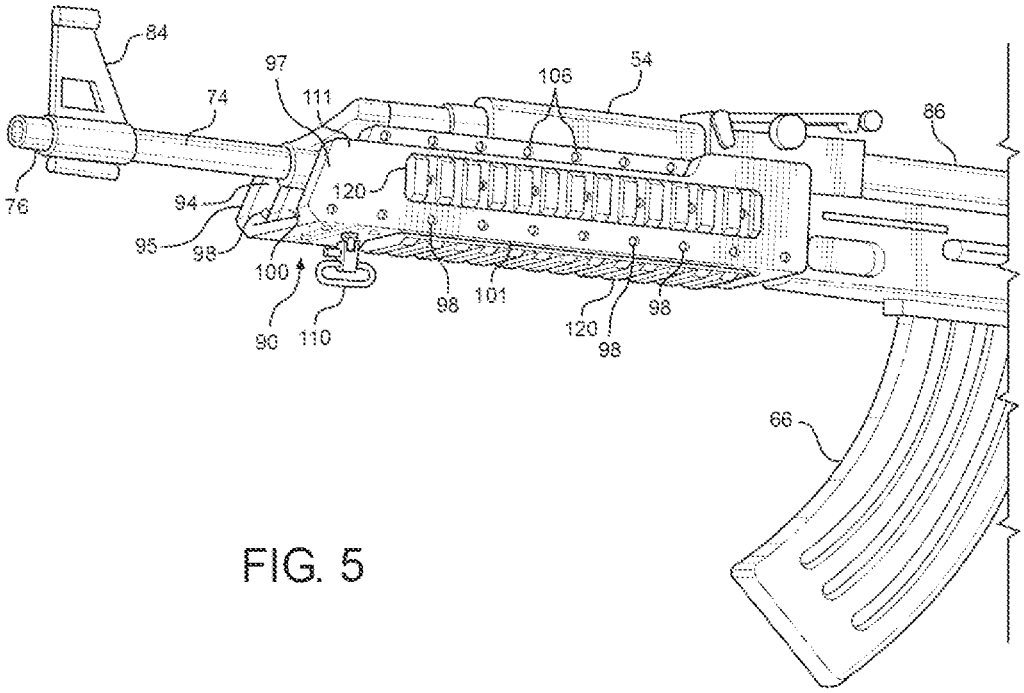
FIG. 5 is an exploded view showing mounting rails and the forend assembly of the present invention.

The bottom hand grip device 90 comprises an elongated body sized to extend forwardly from the distal end 70 of the lower receiver 58 covering the breech end 78 of the barrel 74 and at least some middle part of the barrel 74. The bottom hand grip device 90 comprises a bottom plate 92 provided with a plurality of apertures 93, which can extend along a longitudinal centerline of the bottom plate 92 or in two spaced apart rows, as shown in FIGS. 2-4.

A pair of outside walls 96, 98 extends upwardly from the bottom plate 94, the outside walls 94, 96 having substantially the same length as the bottom plate 94. When mounted on the rifle, a back end of the outside walls abuts the receiver assembly. Each of the outside walls 94, 96 is provided with a row of through openings 98 formed between forward ends 95, 97 of the outside walls 94, 96, respectively and back ends 99 of the outside walls.

It will be understood that even though the outside wall 96 is seen in full view in the drawings, the second outside wall 94 is a mirror image of the outside wall 96 and is similarly provided with a row of through openings 98 extending along the length of the outside wall. The openings 98 are formed adjacent a bottom edge 101 of the outside walls 94, 96.

A pair of inner walls 102, 104 extends upwardly from the bottom plate 92 between the outside walls 94, 96. The inner walls 102, 104 may extend in parallel to the outside walls 94 and 96, respectively, in a spaced-apart relationship thereto. The inner walls 102, 104 each have a discreet height, or vertical dimension, which is at least slightly greater than the height of the adjacent outside wall 94 or 96. In one aspect, the inner walls 102, 104 have smaller longitudinal dimensions that the outside walls 94, 96.

A row of openings 106 is formed in each inner wall 102, 104 adjacent an upper edge 107 thereof. The purpose of the openings 98 and 106 will be explained in more detail hereinafter. A gap or channel 108 is formed between the inner walls 102, 104; the gap 108 being sized and shaped to receive at least a portion of the barrel assembly 54 therebetween. In some aspect, the muzzle end 76 and the front sight 84 of the barrel 74 remain uncovered.

An attachment bolt 110, which can be a tightening bolt, secures the bottom plate, and thus the bottom hand grip device 90 to the barrel cover 82. A connector member 112 extends from the back of the bottom hand grip device 90. The connector member is engageable within the slot 72 formed in the distal end of the lower receiver 52. When the attachment bolt 110 and the connector member 112 are properly engaged with the rifle 50 the bottom grip device 90 is detachably affixed to the rifle 50.

The apertures 93 and openings 98, 106 allow some of the heat generated by the firing mechanism to escape the receiver assembly and the barrel assembly and thereby cool the firearm. Additionally the openings and the apertures form mounting holes for mounting rails.

One or more accessory mounting rails 120 can be engaged with the bottom hand grip device 90. One type of possible mounting rails is Picatinny-style rails per US Government Publication MIL-STD-1913 Revision 10 (July 1999) or a similar suitable mounting rail. The mounting rails 120 allow a variety of accessories to be mounted to the bottom hand grip device 90, such as scopes, tactical flashlights, etc. as conventionally used with field-type rifles.

Each of the mounting rails 120 is provided with a series of openings 122 suitable for receiving screws or bolts 124, or other mechanical engagement means. As can be seen in FIG. 4, the bottom plate 92 can be formed with additional holes 103 along its longitudinal centerline. When the openings 122 are aligned with the openings 103 a mounting rail 120 can be positioned and secured to the bottom plate 92.

The outside walls 94, 96 can be also provided with additional openings 105, which can extend a distance from the bottom edge 101 and an upper edge 111 of the outside walls 94, 96. A side mounting rail 120 can be then detachably engaged with the outside walls 94, 96. The mounting rails of different sizes and types can be detachably secured to the rifle forend 90 in this manner.

Figure 6:
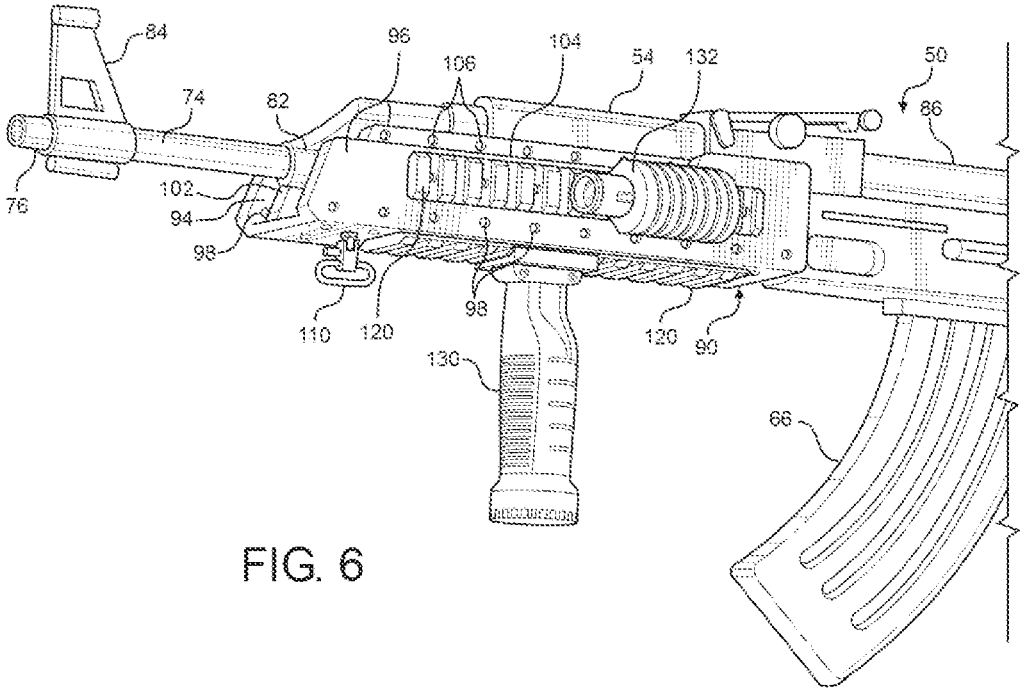
FIG. 6 illustrates positioning of one or more accessories on the mounting rails.

By way of example and not limitation, FIG. 6 illustrates an auxiliary handgrip 130 mounted on a bottom mounting rail 120, which is secured to the bottom plate 92 of the device 90. A tactical light 132 is secured to the side mounting rail 120 attached to the outside wall 96. It should be noted that a mounting rail can be also provided on the outside wall 94. The mounting rails 120 can be either pre-drilled during manufacturing or machined drilled to accommodate the spacing of the openings formed in the bottom plate and the walls of the device 90.

The bottom hand grip device 90 performs a double function of dissipating the heat and acting as a blank platform for utilizing a variety of mounting rails with the firearm 50. For instance, Weaver rail mounts can be engaged with the device 90 and removed when not needed. Picatinny and Weaver rail systems both have slots machined into the rail as a whole. One difference between the Picatinny rail and the Weaver rail is the size of these slots, although many rail-grabber-mounted accessories can be used on either type of rail. Weaver rails have a slot width of 0.180 in (4.572 mm), but are not necessarily consistent in the spacing of slot centers. Since the structure of the bottom hand grip device 90 is capable of engaging with different types of rails, a large variety of accessories can be provided on the rifle 50 depending on the user's preference.

Many changes and modifications can be made in the design of the present invention without departing from the spirit thereof. I, therefore, pray that my rights to the present invention be limited only by the scope of the appended claims.

I claim:

1. A bottom hand grip device for a firearm having a receiver assembly and a barrel assembly, the device comprising: an elongated bottom plate, a pair of outside walls extending upwardly from the bottom plate, a pair of inner walls extending upwardly from the bottom plate inwardly in relation to the outside walls, said pair of inner walls defining a channel therebetween, the channel receiving at least a portion of the barrel assembly therein, wherein each of the inner walls has a vertical aspect, which is at least slightly greater than a vertical aspect of an adjacent outside wall.

2. The device of claim 1, each of said outside walls having a forward end and a back end, and wherein the back end of each outside wall abuts the receiver assembly when the bottom hand grip device is mounted on the firearm.

3. The device of claim 2, wherein each of the outside walls is provided with a row of openings extending between the front end and the back end.

4. A bottom hand grip device for a firearm having a receiver assembly and a barrel assembly, the device comprising: an elongated bottom plate, a pair of outside walls extending upwardly from the bottom plate, a pair of inner walls extending upwardly from the bottom plate inwardly in relation to the outside walls, said pair of inner walls defining a channel therebetween, the channel receiving at least a portion of the barrel assembly therein, wherein, each of said inner plates is provided with a row of apertures formed adjacent an upper end thereof.

5. The device of claim 4, said bottom hand grip device is detachably engageable with at least one mounting rail for positioning of a firearm accessory thereon.

6. A bottom hand grip device for a firearm having a receiver assembly and a barrel assembly, the device comprising: an elongated bottom plate, a pair of outside walls extending upwardly from the bottom plate, a pair of inner walls extending upwardly from the bottom plate inwardly in relation to the outside walls and in a spaced relationship thereto, said pair of inner walls defining a channel therebetween, the channel receiving at least a portion of the barrel assembly therein, said bottom plate, said outside walls and said inner walls each being provided with a plurality of openings allowing heat generated by the firearm to escape, wherein each of the inner walls has a vertical aspect, which is at least slightly greater than a vertical aspect of an adjacent outside wall.

7. The device of claim 6, each of said outside walls having a forward end and a back end, and wherein the back end of each wall abuts the receiver assembly when the bottom hand grip device is mounted on the firearm.

8. The device of claim 6, comprising a means for detachably mounting the bottom hand grip device to the firearm.

9. The device of claim 8, said means for detachably mounting comprising an attachment bolt capable of extending through an opening formed in the bottom plate.

10. The device of claim 9, wherein the receiver assembly is provided with a slot in a lower forward part thereof, and wherein the means for detachably mounting comprises a connector member capably of engaging within said slot.

11. The device of claim 6, said bottom hand grip device is detachably engageable with at least one mounting rail for positioning of a firearm accessory thereon.

* * * * *